US006047956A

United States Patent [19]

Brazina

[11] Patent Number: 6,047,956

[45] Date of Patent: Apr. 11, 2000

[54] ATOMIZING FUEL CARBURETOR

[76] Inventor: Edward A. Brazina, 78 Preston Dr., Branchburg, N.J. 08876

[21] Appl. No.: 08/842,674

[22] Filed: Apr. 15, 1997

[51] Int. Cl.[7] ..... F02M 19/03

[52] U.S. Cl. ..... 261/78.1; 261/79.1; 261/DIG. 39

[58] Field of Search ..... 261/78.1, 79.1, 261/DIG. 39, DIG. 55

[56] References Cited

U.S. PATENT DOCUMENTS

| | | | |
|---|---|---|---|
| 2,011,997 | 8/1935 | Cameron | 261/79.1 X |
| 2,163,139 | 6/1939 | Brandon | 261/79.1 X |
| 2,699,928 | 1/1955 | Mayer et al. | 261/79.1 X |
| 3,301,537 | 1/1967 | De Rugeris | 261/79.1 X |
| 3,332,231 | 7/1967 | Walsh | 261/79.1 X |
| 3,336,017 | 8/1967 | Kopa | 261/79.1 X |
| 3,648,988 | 3/1972 | Dibert | 261/DIG. 39 |
| 3,796,413 | 3/1974 | Woods | 261/78.1 X |
| 3,868,936 | 3/1975 | Rivere | 261/DIG. 39 |
| 3,883,622 | 5/1975 | Woods | 261/78.1 |
| 3,917,758 | 11/1975 | Huff | 261/78.1 X |
| 4,012,468 | 3/1977 | Kikuchi | 261/78.1 |
| 4,269,793 | 5/1981 | Ibbott | 261/78.1 X |
| 4,311,126 | 1/1982 | Cowles | 261/78.1 X |
| 4,335,693 | 6/1982 | Cowles | 261/78.1 X |
| 4,375,438 | 3/1983 | McKay | 261/DIG. 39 |
| 4,427,604 | 1/1984 | Pawelski | 261/78.1 X |
| 4,485,795 | 12/1984 | Lockard | 261/79.1 X |
| 4,966,735 | 10/1990 | LoRusso | 261/78.1 X |
| 4,968,458 | 11/1990 | Besnia | 261/78.1 |
| 4,980,097 | 12/1990 | Edmonston | 261/78.1 X |
| 5,342,555 | 8/1994 | Edmonston | 261/78.1 X |
| 5,385,121 | 1/1995 | Feiss | 261/DIG. 13 |
| 5,386,145 | 1/1995 | Boswell | 261/78.1 X |

OTHER PUBLICATIONS

Mikuni Super BN Carburetors, Watercraft Carburetor Owner's Manual, Revised Oct. 1995 (23 pages).

*Primary Examiner*—Richard L. Chiesa
*Attorney, Agent, or Firm*—John W Logan, Jr.

[57] ABSTRACT

A carburetor atomizer including a cylindrical body with a central bore is disclosed. The body is arranged upstream of the venturi and throttle plate. The bore is oriented parallel to the flow axis of the carburetor. The body has one or more annular conduits circumferentially arranged around the bore, each conduit communicating with the bore through a respective plurality of circumferentially spaced ducts, which can be radially or tangentially oriented relatively to the bore. Respective feeder tubes supply at least one annular conduit with fuel which is drawn into the bore through the ducts where the fuel is broken-up into droplets and mixed with air flowing through the carburetor and bore. Metered air is injected into the bore through a second annular conduit and plurality of ducts which promotes further atomization of the fuel and mixing of the fuel-air mixture in the bore. A passageway is provided between the inlet end of the bore and the annular conduit wherein ram air causes a region of higher pressure to counteract fuel siphoning into the bore at engine idle speeds.

22 Claims, 7 Drawing Sheets

ATOMIZING FUEL CARBURETOR

FIELD OF THE INVENTION

This invention relates to atomizers for use with carburetors and for use with internal combustion engines.

BACKGROUND OF THE INVENTION

The carburetor plays an important part in determining engine performance, especially with regard to power output, torque output, acceleration, response to movement of the throttle, fuel efficiency and exhaust emissions. The carburetor meters liquid fuel and promotes its mixture with air, thereby creating an optimum fuel-air mixture appropriate to engine demand for a given engine operating point.

Of the many types of carburetors in existence, those carburetors comprising a barrel having a centrally disposed venturi and mounting a throttle valve downstream of the venturi and an atomizer upstream of the venturi are of particular interest, as carburetors of this design have proven themselves to be particularly successful when used on high performance engines. Although this carburetor design appears relatively simple in principle, it is possible to achieve significant engine performance improvements by means of subtle and innovative design modifications to the basic carburetor system.

SUMMARY AND OBJECTS OF THE INVENTION

This invention comprises an atomizer for use with carburetors, the atomizer comprising a preferably cylindrical body located within the barrel of a carburetor upstream of or in the venturi, which in turn is upstream of the throttle plate or valve. The cylindrical body has a bore therethrough, the bore being aligned parallel with the flow axis of the carburetor barrel along which air flows from the ambient to the engine. The bore has an inlet, an outlet and a restricted throat between the inlet and outlet. The diameter of the bore varies along the length of the bore, being larger at the inlet, reducing to a smaller size throughout the throat and then enlarging again at the outlet to form a venturi within the bore. An annular conduit is located within the body, the conduit being disposed circumferentially around the bore. An aperture is located in the cylindrical side wall of the body, preferably perpendicular to the bore axis. The aperture communicates between the outer surface of the body and the annular conduit. A fuel feeder tube is connected to the aperture which supplies fuel to the annular conduit when the carburetor is in operation.

A plurality of ducts having a relatively small diameter extend through the body from the bore to the annular conduit. The ducts are circumferentially spaced around the bore and could be oriented radially along diametral lines passing through the center of the bore, but it is preferable to angle the ducts tangentially away from the center. Tangentially arrayed ducts impart a rotational flow to the fuel as it passes from the fuel tube through the annular conduit, through the ducts and into the bore. The ducts' diameters are relatively small, thus allowing only small droplets of fuel to enter the bore which promotes atomization of the fuel as it leaves the ducts and enters the rapidly moving air stream flowing through the bore. The rotational flow imparted by the tangential orientation of the ducts promotes further atomization of the fuel and mixing of the atomized fuel with the air flowing through the carburetor barrel and the atomizer, thereby forming a finely atomized fuel-air mixture. The fuel air mixture next passes into the venturi, moves past the throttle plate and eventually into the cylinder.

Although the diameters of all of the ducts could be equal in size, it is advantageous to vary the duct diameters in proportion to their distance from the fuel feeder tube, wherein ducts closer to the feeder tube have smaller diameters than ducts further away around the annular conduit. Varying the size of the ducts in this manner promotes a more even distribution of fuel into the bore. When all of the ducts have the same diameter more fuel tends to enter the bore through ducts closer to the fuel feeder tube than those ducts further around the annular conduit. It is well known that the further a fluid travels through a conduit, the greater the energy losses are due to friction between the fluid and the conduit walls. Thus fuel which must travel the entire circumference of the annular conduit before entering the bore will be forced through the duct at a slightly lower pressure than fuel which travels a shorter distance through the conduit before being discharged into the bore. The slight difference in discharge pressure caused by the friction losses manifests itself as an unequal flow of fuel through ducts at varying distances from the feeder tube and increasing the duct diameter with distance compensates for the pressure loss and equalizes the fuel flow through all of the ducts.

The duct diameters are smaller than the cross section of the annular conduit, allowing the ducts to intersect the annular conduit at a variety of positions relative to the cross section. It is preferred to have the ducts meet the annular conduit at the forward most region of the annular conduit cross section. This arrangement of intersection between duct and conduit prevents fuel siphoning during engine deceleration by allowing air to enter the duct and thereby breaking the siphon.

In another means used to prevent siphoning of fuel into the bore during engine deceleration a passageway is provided between the bore and the annular conduit, the passageway intersecting the annular conduit at the fuel aperture. The passageway opens to the bore upstream of the annular conduit near the outlet, preferably on a surface of the bore which is not tangential to the air flow, but at an angle to the air flow which causes the airflow to impinge on the surface. Orienting the passageway opening at an impinging angle to the air flow causes air to flow by a ram air effect within the passageway when air flows through the bore, a small portion of the air flow entering the passageway and being channeled to the annular conduit and the fuel tube. During conditions of low air flow rates through the carburetor the suction effect within the bore is reduced allowing the air flow to the conduit through the passageway to disrupt the siphon effect and thereby counteract the tendency for the fuel to siphon from the fuel tube through the annular conduit and into the bore.

Without some means for preventing siphoning, such as the passageway or the specially positioned ducts, fuel would tend to siphon into the bore as long as there is air flowing through the carburetor since the bore has the characteristics of a venturi, and there is a region of low pressure at the throat of the bore adjacent to the ducts which creates a suction at the ducts to draw the fuel into the bore. Normally at engine idle, as when the throttle plate is closed during deceleration, fuel is provided to the engine only by an idle port, positioned downstream of the throttle plate, which precisely meters the fuel to the engine needed for smooth idling. It is preferable not to have additional fuel entering the carburetor through the atomizer at engine idle speeds through the siphoning action as this is a waste of fuel which produces an excessively rich fuel-air mixture and causes the engine to run rough. During engine deceleration a carburetor is especially prone to fuel siphoning because of fuel pressure. But since the throttle plate is closed air flow through the carburetor is restricted and the engine's demand for fuel is decreased, resulting in ample quantities of fuel being available but only small amounts of air available to support combustion. The low air flow through the bore easily siphons the fuel from the ducts which is readily replaced by the fuel pump, enriching the fuel-air mixture entering the engine and causing the rough running.

It is possible to improve the anti-siphoning action of the passageway by enlarging the opening of the passageway at the bore, creating a funnel shaped opening which channels more air into the passageway, thereby increasing the dynamic pressure within the annular conduit, without increasing the diameter of the passageway over its length.

The position of the atomizer relative to the flow axis through the carburetor is also an important factor in the operation of the carburetor. The established practice is to position the center of the atomizer's bore colinearly with the centerline of the flow axis. However, it has been found advantageous at times to offset the bore of the atomizer from the centerline of the flow axis, preferably toward the fuel tube. The offset improves throttle response by shortening the fuel tube, and hence, the distance fuel must travel before being atomized in the bore of the atomizer.

Dynamometer tests comparing the performance of a two stroke engine using a stock carburetor with the same carburetor employing the improved atomizer design according to the invention show an improvement of approximately 5 hp output over an RPM range of 6100 to 7100 RPM. In addition, the atomizer design of the present invention greatly increases response of the engine to a change in throttle position and minimizes the acceleration lag time of the engine. In two-stroke cycle engines with conventional carburetors, acceleration of the engine can lag throttle advance by as much as 175 to 200 RPM.

Further improvement of the atomization of fuel and the mixing of fuel and air is possible by adding a second annular conduit to the body. The second annular conduit, similar to the first described above, is disposed circumferentially within the body about the bore and has a second plurality of circumferentially spaced ducts which communicate between the second annular conduit and the bore. The second plurality of ducts can be oriented radially along diametral lines between the bore and the conduit, but it is preferable to orient the ducts at an angle tangentially to the bore for reasons explained below. The second plurality of ducts preferably open onto the bore downstream from the first plurality of ducts.

A second feeder tube is connected to the second annular conduit through a second aperture in the cylindrical sidewall of the body. The second feeder tube conducts a metered supply of air or a metered fuel-air mixture to the second annular conduit, through the second plurality of ducts and into the bore downstream of the first plurality of ducts. The metered air enters the bore and creates turbulence within the fuel-air mixture stream passing through the bore. The turbulence further breaks-up the droplets into an even finer mist than delivered by the first plurality of ducts and promotes even more thorough mixing of the fuel and air entrained in the stream passing through the bore. Providing the second plurality of ducts with a tangential angular orientation relatively to the bore imparts a rotational flow to the metered air entering the bore, thus further facilitating mixing of the atomized fuel and air. The improved mixing of fuel and air increases engine performance, providing increased power output, increased torque, more efficient combustion, lower pollution and increased fuel economy over a wide range of engine operating speeds and loads.

DETAILED DESCRIPTION OF THE PREFERRED EMBODIMENTS

Figure 1:
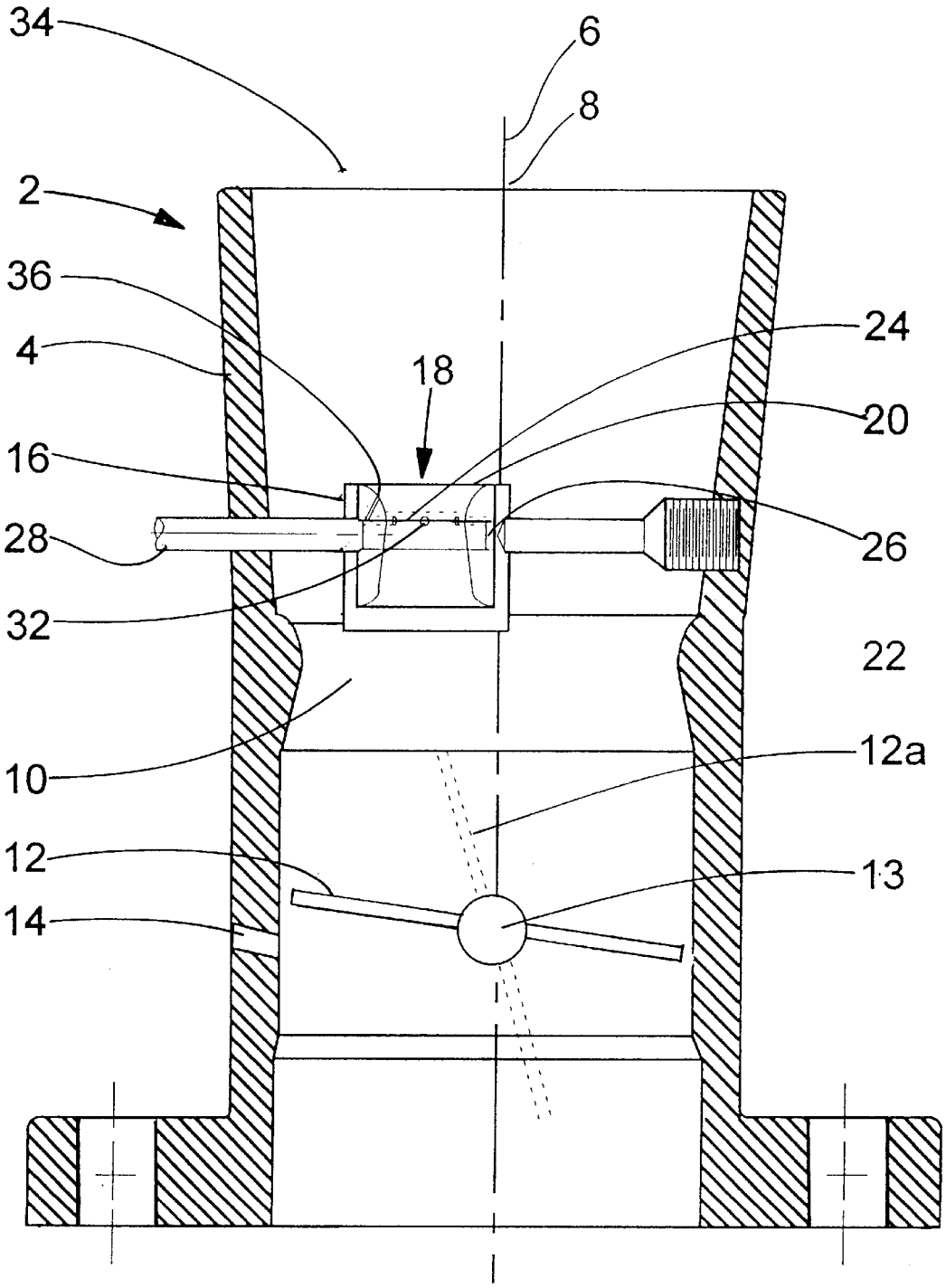
FIG. 1 is a longitudinal sectional view of a carburetor having an improved atomizer according to the invention.

FIG. 1 shows a carburetor 2 comprising barrel 4 having a centerline 6 and a flow axis 8 parallel to the centerline. Midway down barrel 4 is a venturi 10 and downstream from the venturi is the throttle plate 12. An idle port 14 is positioned in the barrel downstream of throttle plate 12 to provide fuel to the engine at idle speed.

Figure 2:
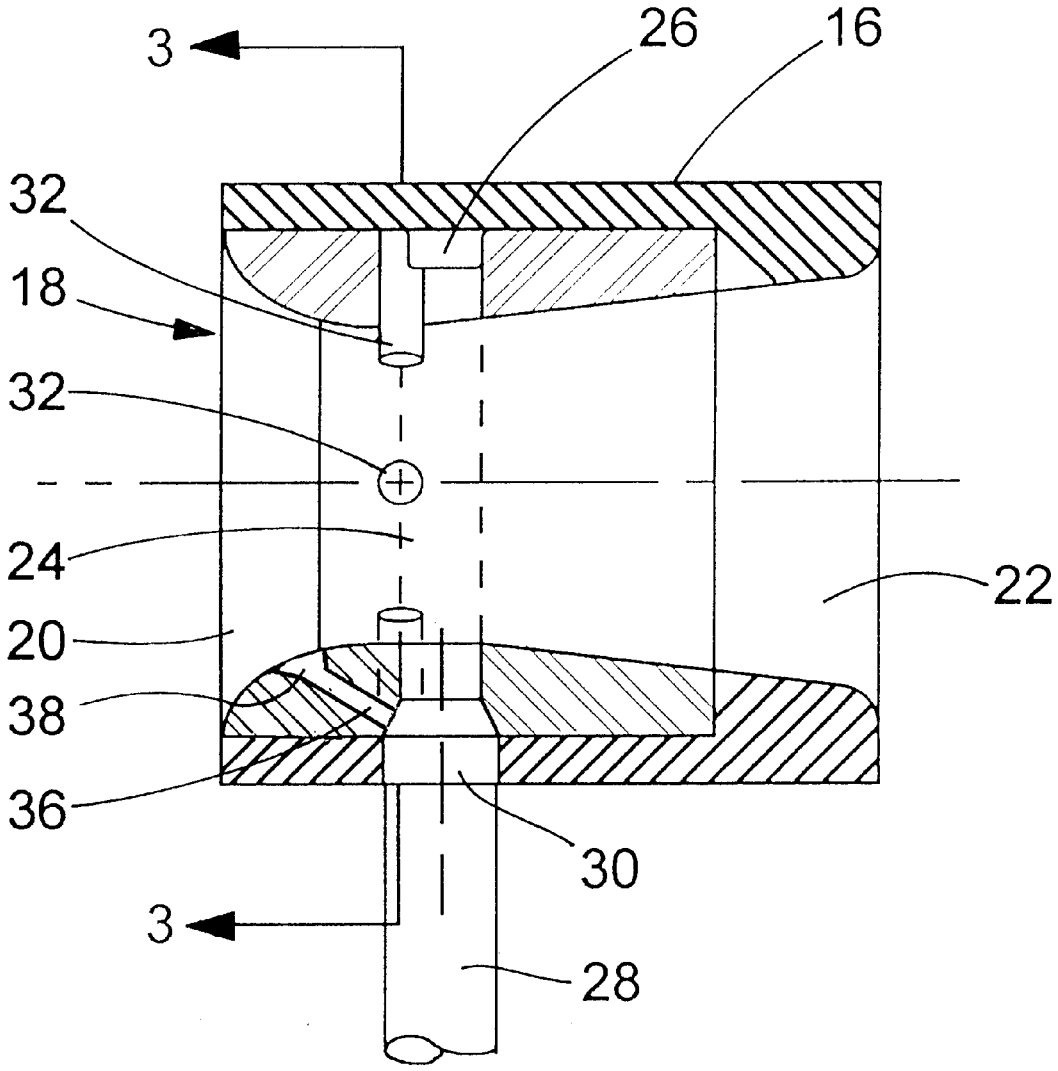
FIG. 2 is a detailed longitudinal sectional view of the improved atomizer from FIG. 1 shown on an enlarged scale.
Figure 3:
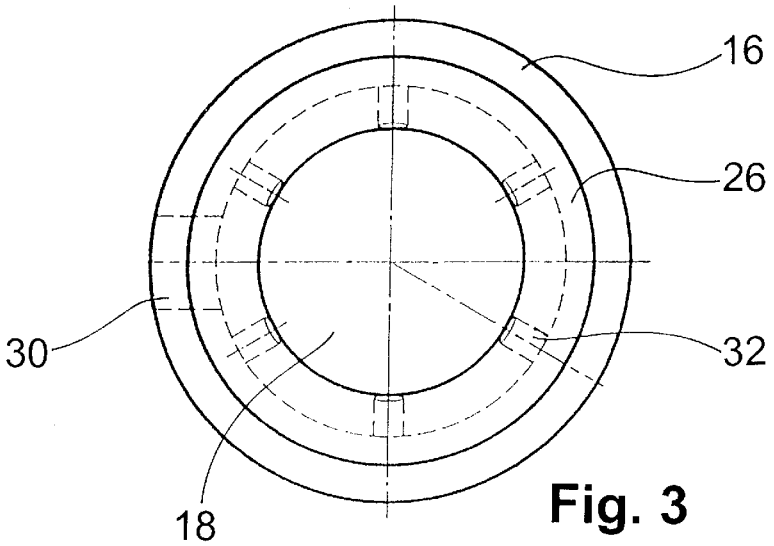
FIG. 3 is a detailed cross sectional view of an improved atomizer taken along line 3—3 of FIG. 1.

A cylindrical atomizer body 16, shown in greater detail in FIGS. 2 and 3, is mounted within barrel 4 upstream of venturi 10. Body 16 has a central bore 18 therethrough. Bore 18 has an inlet 20, an outlet 22 opposite inlet 20 and a throat 24 disposed between the inlet and the outlet. As best seen in FIG. 2 the diameter of the bore varies, being relatively larger at inlet 20, narrower at throat 24 and then larger again at outlet 22. The bore geometry forms a venturi within body 16.

Figure 4:
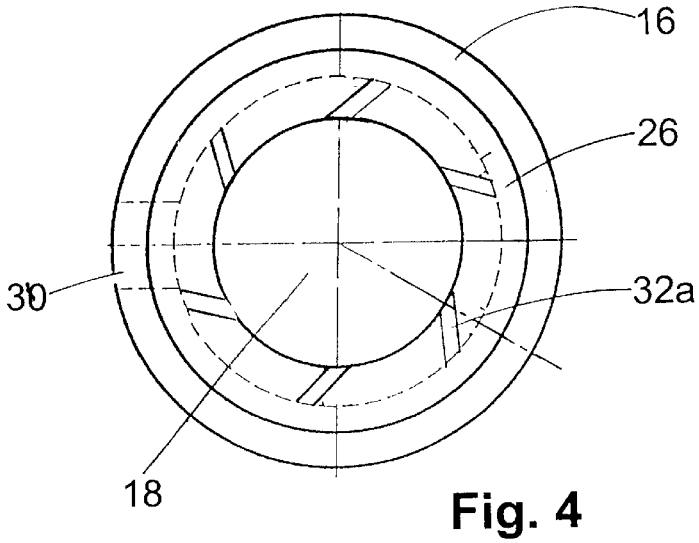
FIG. 4 is a detailed cross sectional view of the improved atomizer from FIG. 3 having tangentially angled ducts.
Figure 9:
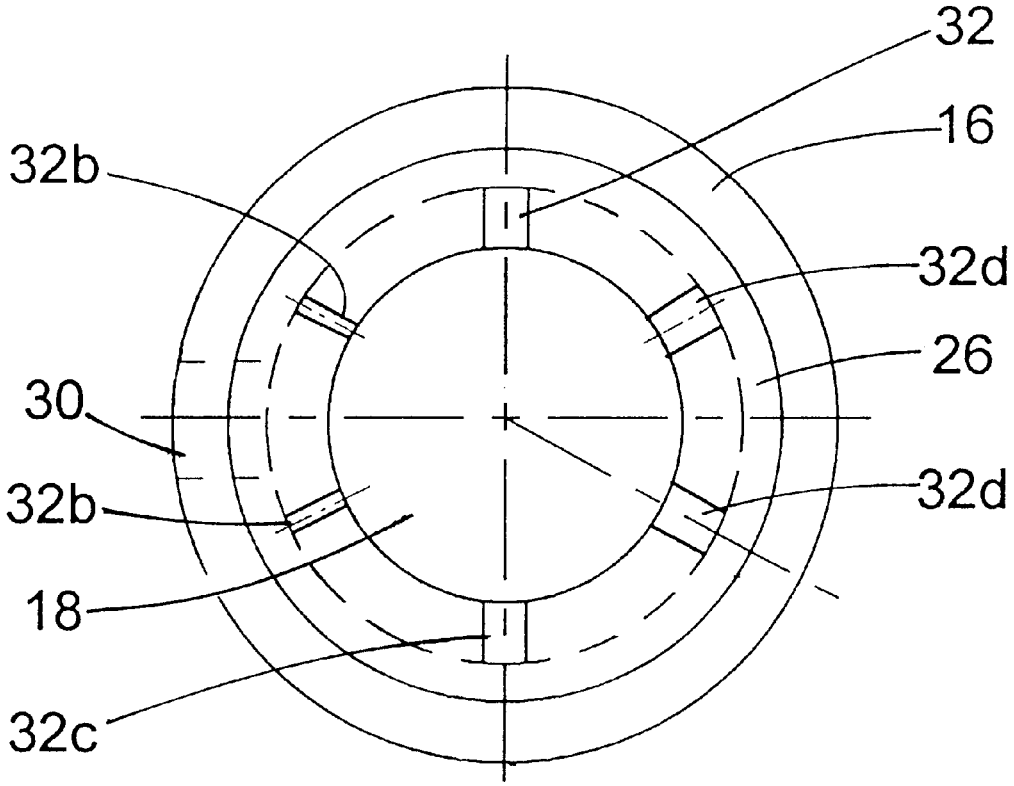
FIG. 9 is a detailed cross sectional view of an improved atomizer from FIG. 3 having ducts of varying diameters.

An annular conduit 26, seen in FIG. 2, is formed within body 16 adjacent to the throat 14 and is oriented circumferentially about bore 18. A first feeder tube 28 enters body 16 through aperture 30 in the body sidewall and communicates with annular conduit 26, as best shown in FIG. 2. A plurality of ducts 32 are circumferentially spaced in body 16 around bore 18, ducts 32 communicating between annular conduit 26 and central bore 18. Ducts 32 can be radially oriented along diametral lines, as seen in FIG. 3, or the ducts can be angularly oriented tangentially to the bore as shown in FIG. 4 at 32a. The advantages of the various duct orientations is explained further below. In addition to varying the orientation of the ducts 32, it is advantageous to vary the diameter as seen in FIG. 9 at 32*b*–*d*. Ducts 32*b*, positioned nearer to the fuel supply point (aperture 30), have a smaller diameter than ducts 32*c*, which are further away from the fuel supply point along conduit 26. In turn, ducts 32*c* have a smaller diameter than ducts 32*d* which are farthest from the fuel supply point 30. The diameter variation with distance ensures that fuel will be supplied to the bore uniformly from all of the ducts regardless of their position on the conduit. As explained above, fuel flowing through conduit 26 experiences a slight pressure loss due to friction between the fuel and conduit walls. The frictional loss is proportional to the distance traveled through the conduit, thus fuel which travels to the furthest conduits 32*d* before discharge into bore 18 is at a slightly lower pressure than fuel which enters the bore via ducts 32*b*. When all duct diameters are equal the slight discrepancy in pressure results in a non-uniform discharge of fuel into bore 18, less fuel entering the bore through the farther ducts. By enlarging the duct diameters in proportion to the distance around the conduit 26 it is possible to compensate for the pressure drop and ensure a uniform fuel discharge to the bore, as the in creased duct area of the larger ducts allows the same amount of fuel to enter the bore under lower pressure as enters the bore through a smaller duct under higher pressure. Note that the sizes of the ducts 32 are exaggerated for clarity of explanation and in no way represent actual sizes.

As seen in FIG. 2 the cross section of annular conduit 26 is substantially larger than the cross section of ducts 32. The size difference permits ducts 32 to intersect any of various points on the cross section of annular conduit 26. It is found preferable to bring ducts 32 into annular conduit 26 at the forward most region of the conduit cross section, closest to inlet 20 of bore 18 as practicable. Preferably, as shown in FIG. 2, approximately half of the duct cross section actually engages or intersects the conduit. Positioning the ducts in this manner relatively to the conduit allows air to enter the duct from the bore during conditions of low air flow through the carburetor, such as during engine deceleration or at idle speed. Allowing air to enter the ducts breaks up the siphon effect and inhibits the tendency of fuel to be continuously drawn into the bore and enrich the mixture, wasting fuel and causing the engine to run roughly, as described above.

In operation air is drawn into an engine (not shown) through carburetor 2, the air entering the barrel 4 at its upstream end 34 and moving downstream along flow axis 8, a portion of the air stream moving through bore 18, through venturi 10, past throttle plate 12 and then into the engine. Fuel is provided through feeder tube 28 and enters annular conduit 26 where the fuel is conveyed to bore 18 through the plurality of ducts 32. The relatively small diameter of ducts 32 causes the fuel entering the bore to break-up into small droplets which readily mix with the incoming air stream. Throat 24 of body 16 behaves like a venturi, accelerating the speed of the air flow and reducing the air pressure within the bore, drawing the fuel into the air stream, creating a fuel-air mixture which exits bore 18 and passes through venturi 10 and then past throttle plate 12 and onward into the engine. If ducts 32 are oriented radially along diametral lines as seen in FIG. 3 the fuel is drawn straight into the air stream; however, if the ducts are oriented at a tangential angle as shown at 32*a* in FIG. 4 a rotational flow will be imparted to the fuel-air mixture stream as it exits the bore through outlet 22. The rotational flow provides energy to break-up the fuel droplets into an even finer mist and promotes further mixing of the fuel-air mixture on its way through barrel 4 to the engine.

It has been found advantageous to offset bore 18 from center line 6 of barrel 4, as shown in FIG. 1. Preferably, the offset is toward feeder tube 28. The offset position of bore 18 shortens feeder tube 28, thereby lessening the distance which fuel must travel before it enters bore 18. The offset thereby results in faster throttle response as the fuel need not travel as far when throttle plate 12 is opened and more fuel is required to increase the engine speed for acceleration. There is normally a time lag between when the throttle is opened and when the engine responds, and the offset position of the bore toward the feeder tube tends to counteract the response lag. An added advantage provided by the offset position of bore 18 is that when the throttle is wide open as shown in FIG. 1 at 12*a*, air entering the bore proceeds downstream substantially unimpeded by the throttle plate and its pivot shaft 13, thus moving directly to the engine intake.

When the throttle plate is closed, or nearly closed, as seen at 12 in FIG. 1, the engine can run at idle speed. Fuel is provided to the engine through idle port 14 located downstream of throttle plate 12. Port 14 provides a metered amount of fuel to keep the engine smoothly idling without conking out or revving too high and wasting fuel. However, due to the venturi effect of throat 24 in bore 18 mentioned above, fuel tends to be siphoned through ducts 32 and into the air stream entering the carburetor 2. Fuel siphoning is especially acute during engine deceleration when more fuel than necessary is supplied to the carburetor by the fuel pump, as explained above. The fuel siphoning wastes fuel and makes it difficult to control the idling speed of the engine by enriching the fuel-air mixture and causing rough running. To prevent unwanted siphoning of fuel, a passageway 36 is provided between the bore 18 and annular conduit 26 preferably adjacent to the point of intersection of feeder tube 28 and annular conduit 26 as seen in FIG. 2. Passageway 36 preferably opens onto bore 18 upstream of ducts 32 near the inlet 20 on a surface of the bore which is not tangential to the air flow through the bore. During low air flow regimes such as engine idle or deceleration a small portion of the air entering bore 18 will enter passageway 36 and be channeled into annular conduit 36, providing an air bubble which breaks up the siphon at the intersection of fuel tube 28 and conduit 26 thus inhibiting fuel from being drawn into the bore by the small suction present during low air flow. At higher air flow rates however the venturi effect of the throat 24 effectively draws fuel readily through the ducts into the bore to mix with the incoming air. The open end of passageway 36 can be flared or funnel shaped, as seen at 38 in FIG. 2, the shape of the end opening and the diameter of the passageway controlling the relative effectiveness of the passageway to prevent fuel siphoning.

Figure 7:
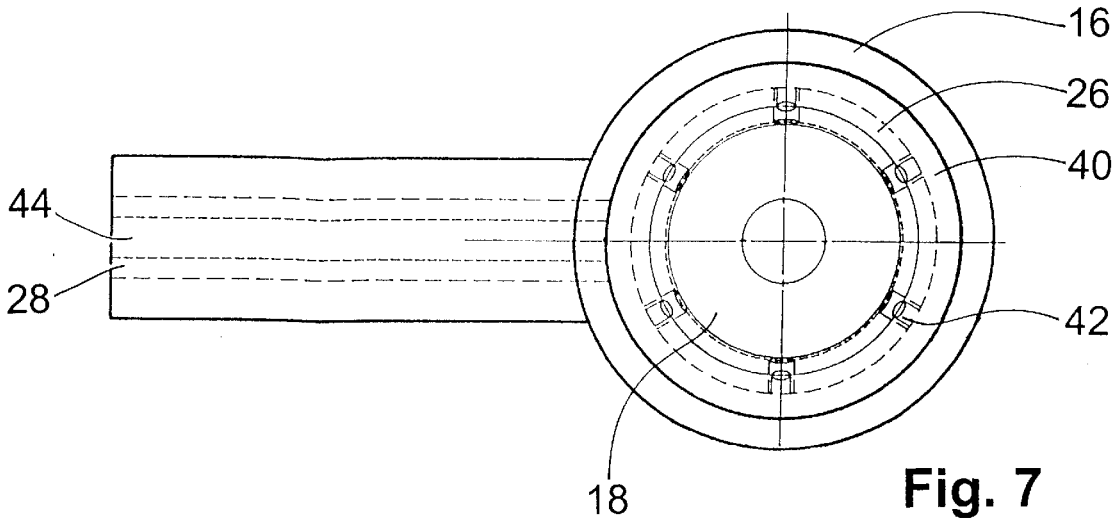
FIG. 7 is a detailed cross sectional view of the improved atomizer taken along line 7—7 of FIG. 6.
Figure 5:
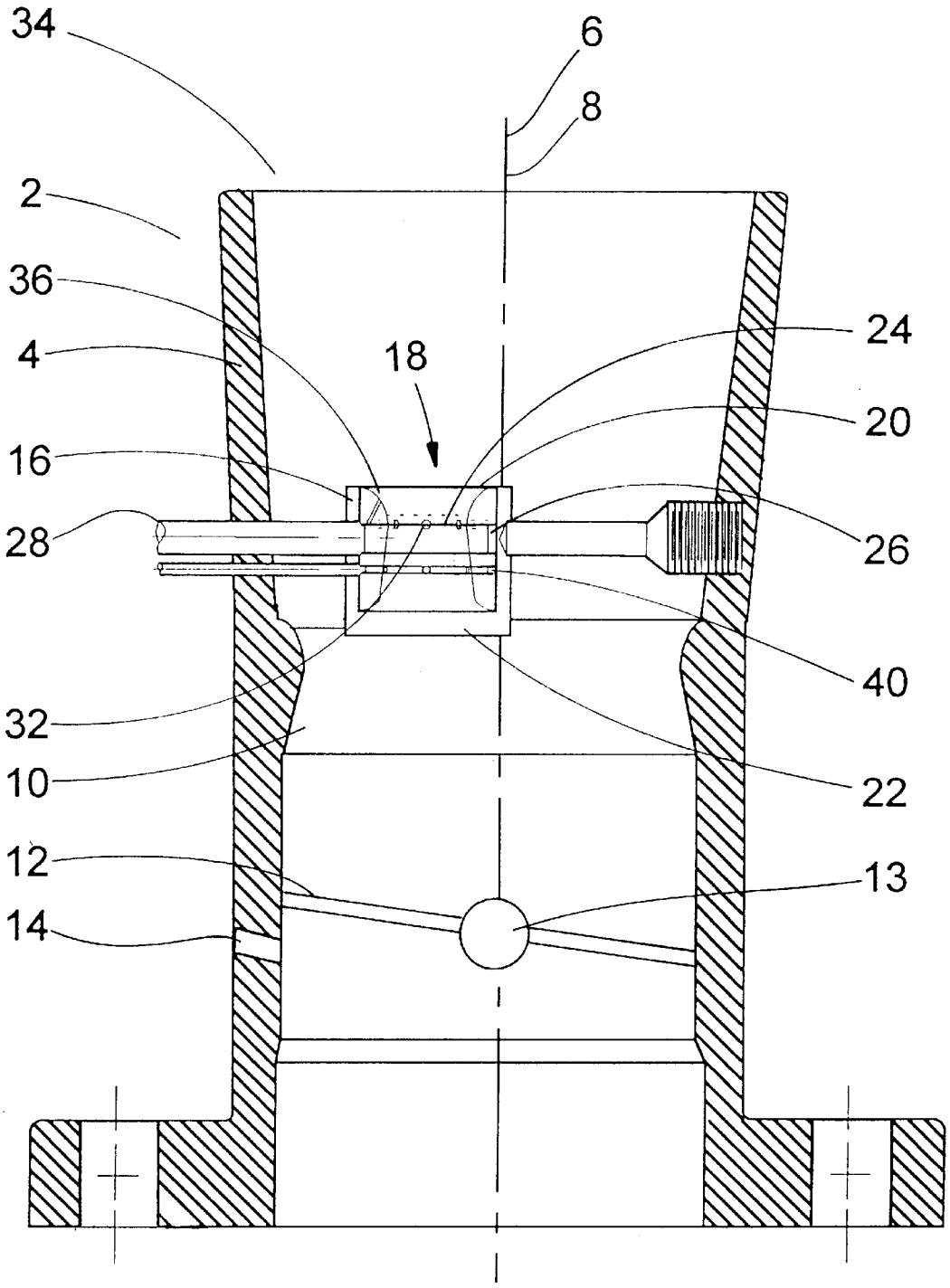
FIG. 5 is a longitudinal sectional view of a carburetor having an improved atomizer according to the invention.
Figure 6:
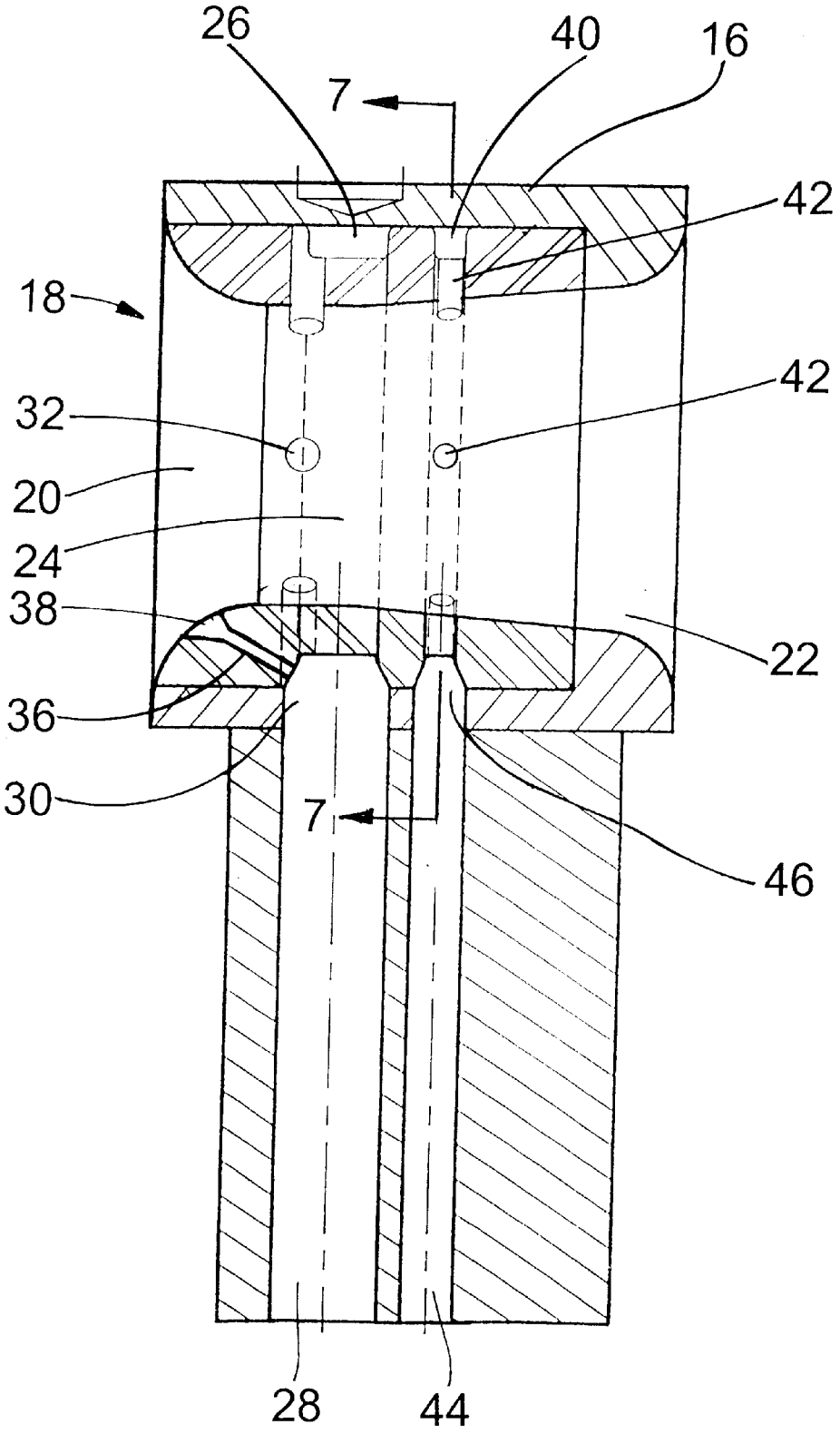
FIG. 6 is a detailed longitudinal sectional view of the improved atomizer from FIG. 5 shown on an enlarged scale.

The atomizer can be further improved by providing a second annular conduit 40, seen in FIG. 5 and displayed in detail in FIG. 6. Second annular conduit 40 is also arranged circumferentially around bore 18 and is connected to the bore by a second plurality of circumferentially spaced ducts 42 which open into bore 18 in throat 24 downstream from the first plurality of ducts 32. Again, ducts 42 can be radially oriented along diametral lines as shown in FIG. 7 or angularly oriented tangentially as seen at 42*a* in FIG. 8. A second feeder tube 44 communicates with second annular conduit 40 through a second aperture 46 in the cylindrical sidewall of body 16.

Figure 8:
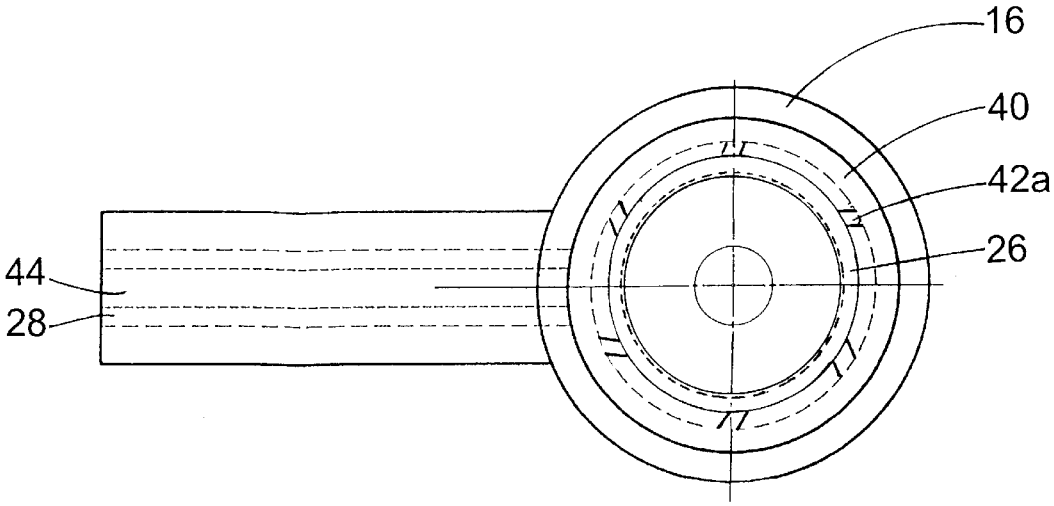
FIG. 8 is a detailed cross sectional view of an improved atomizer from FIG. 7 having tangentially angled ducts.

In the preferred embodiment of an atomizer according to the invention a metered amount of air is injected into second feeder tube 44. The metered air is conducted through the second feeder tube 44 into the second annular conduit 40 and through the second plurality of ducts 42 and then into bore 18. The metered air entering bore 18 through ducts 42 promotes even further mixing of the fuel-air mixture flowing through bore 18 and exiting body 16 through outlet 22. The metered air may be injected radially into bore 18 through radially oriented ducts 42 or the metered air can be given a rotational flow within the bore if the tangentially oriented ducts 42*a* are used, as shown in FIG. 8. Instead of only air through the second conduit and ducts, a metered fuel-air mixture may be supplied. Either way, the metered air and/or fuel-air mixture creates further turbulence to both break-up the fuel droplets into an even finer vapor and promote thorough mixing of fuel and air within the carburetor.

While a preferred embodiment of the invention has been described herein, it should be apparent to one skilled in the art that various changes and modifications can be made without departing from the true spirit and scope of the invention as recited in the appended claims.

I claim:

1. An atomizer for use in a carburetor having a flow axis along which air flows within the carburetor, the flow axis having a centerline, said atomizer comprising:

a body disposed within the carburetor, said body having a bore there through, said bore having an inlet, an outlet disposed opposite said inlet and a throat disposed between said inlet and outlet, said bore being aligned parallel with said flow axis, said bore having a variable diameter, said diameter being relatively larger at said inlet, said diameter being relatively smaller at said throat, said diameter being relatively larger at said outlet;

an annular conduit formed within said body and disposed circumferentially about said bore between said inlet and said outlet, said body having a plurality of circumferentially spaced apart ducts communicating between said annular conduit and said bore, said annular conduit having a forward region disposed toward said inlet, at least one of said ducts communicating with said forward region, said ducts opening into said bore in said throat;

a fuel tube communicating with said annular conduit and extending outwardly from said body, said fuel tube supplying fuel to said annular conduit, said fuel flowing from said annular conduit through said ducts and into said bore, said fuel mixing with air in said bore forming a fuel-air mixture; a second annular conduit formed within said body and disposed circumferentially about said bore between said inlet and said outlet, said body further having a second plurality of circumferentially spaced apart ducts communicating between said second annular conduit and said bore, said second plurality of ducts opening into said opening into said bore in said throat;

a feeder tube communicating with said second annular conduit and extending outwardly from said body, said feeder tube supplying metered air to said second annular conduit, said metered air flowing from said second annular conduit through said second plurality of ducts into said bore, said metered air mixing with said fuel-air mixture.

2. An atomizer according to claim 1, wherein at least one duct of said second plurality of ducts is oriented radially relatively to said bore.

3. An atomizer according to claim 1, wherein at least one duct of said second plurality of ducts is angularly oriented tangentially to said bore.

4. An atomizer according to claim 1, wherein at least one duct of said second plurality of ducts opens into said bore downstream of at least one duct of said first plurality of ducts.

5. An atomizer for use with a carburetor having a flow axis along which air flows within the carburetor, the flow axis having a centerline, said atomizer comprising:

a body disposed within the carburetor, said body having a bore therethrough, said bore being aligned parallel with the flow axis, said bore having an inlet, an outlet disposed opposite said inlet and a throat disposed between said inlet and outlet, said bore having a varying diameter, said diameter being relatively larger at said inlet, said diameter being relatively smaller at said throat, said diameter being relatively larger at said outlet;

a first annular conduit formed within said body and disposed circumferentially about said bore between said inlet and said outlet, said body having a first plurality of circumferentially spaced apart ducts communicating between said first annular conduit and said bore, said first plurality of ducts opening into said bore in said throat;

a second annular conduit formed within said body and disposed circumferentially about said bore between said inlet and said outlet, said body having a second plurality of circumferentially spaced apart ducts communicating between said second annular conduit and said bore, said second plurality of ducts opening into said bore in said throat downstream of said first plurality of ducts;

a first feeder tube communicating with said first annular conduit and extending outwardly from said body;

a second feeder tube communicating with said second annular conduit and extending outwardly from said body;

fuel supply means;

said fuel being supplied through one of said first and second feeder tubes to one of said first and second annular conduits and further through one of said first and second plurality of ducts to said bore, said fuel mixing with air in said bore forming a fuel-air mixture;

metered air supply means;

said metered air being supplied through an other of said first and second feeder tubes to an other of said first and second annular conduits and further through an other of said first and second plurality of ducts to said bore, said metered air mixing with the fuel-air mixture in said bore.

6. An atomizer according to claim 5, further comprising:

a passageway within said body between said bore and said one annular conduit, said passageway opening on said bore upstream of said one annular conduit.

7. An atomizer according to claim 6, wherein said passageway has an enlarged opening at said bore, said enlarged opening funneling air into said passageway.

8. An atomizer according to claim 5, wherein said bore is disposed offset from the centerline of the flow axis.

9. An atomizer according to claim 5, wherein said bore is offset from the centerline of the flow axis toward said one feeder tube.

10. An atomizer according to claim 5, wherein at least one duct of said first plurality of ducts is oriented radially relatively to said bore.

11. An atomizer according to claim 5, wherein at least one duct of said second plurality of ducts is oriented radially relatively to said bore.

12. An atomizer according to claim 5, wherein at least one duct of said first plurality of ducts is disposed at an angle tangentially to said bore.

13. An atomizer according to claim 5, wherein at least one duct of said second plurality of ducts is disposed at an angle tangentially to said bore.

14. An atomizer according to claim 5, wherein said one annular conduit has a forward region disposed toward said inlet and at least one duct of said one plurality of ducts communicating with said one annular conduit at said forward region.

15. An atomizer for use with a carburetor having a flow axis along which air flows within the carburetor, the flow axis having a centerline, said atomizer comprising:

a body disposed within the carburetor, said body having a bore therethrough, said bore being aligned parallel with the flow axis, said bore having an inlet, an outlet disposed opposite said inlet, and a throat disposed between said inlet and outlet, said bore having a varying diameter, said diameter being relatively larger at said inlet, said diameter being relatively smaller at said throat, said diameter being relatively larger at said outlet;

a first annular conduit formed within said body and disposed circumferentially about said bore between said inlet and said outlet, said body having a first plurality of circumferentially spaced apart ducts communicating between said first annular conduit and said bore, said first plurality of ducts opening into said bore in said throat;

a second annular conduit formed within said body and disposed circumferentially about said bore between said inlet and said outlet, said body having a second plurality of circumferentially spaced apart ducts communicating between said second annular conduit and said bore, said second plurality of ducts opening into said bore in said throat downstream of said first plurality of ducts;

a first feeder tube communicating with said first annular conduit and extending outwardly from said body;

a second feeder tube communicating with said second annular conduit and extending outwardly from said body;

fuel supply means;

said fuel being supplied through one of said first and second feeder tubes to one of said first and second annular conduits and further through one of said first and second plurality of ducts to said bore, said fuel mixing with air in said bore forming a fuel-air mixture;

metered fuel-air mixture supply means;

said metered fuel-air mixture being supplied through an other of said first and second feeder tubes to an other of said first and second annular conduits and further through an other of said first and second plurality of ducts to said bore, said metered fuel-air mixture mixing with the fuel-air mixture in said bore.

16. An atomizer according to claim 15, wherein said bore is disposed offset from the centerline of the flow axis.

17. An atomizer according to claim 15, wherein said bore is offset from the centerline of the flow axis toward said one feeder tube.

18. An atomizer according to claim 15, wherein at least one duct of said first plurality of ducts is oriented radially relatively to said bore.

19. An atomizer according to claim 15, wherein at least one duct of said second plurality of ducts is oriented radially relatively to said bore.

20. An atomizer according to claim 15, wherein at least one duct of said first plurality of ducts is disposed at an angle tangentially to said bore.

21. An atomizer according to claim 15, wherein at least one duct of said second plurality of ducts is disposed at an angle tangentially to said bore.

22. An atomizer according to claim 15, wherein said one annular conduit has a forward region disposed toward said inlet, and at least one duct of said one plurality of ducts intersects said one annular conduit at said forward region.

* * * * *